US006951072B2

(12) United States Patent
Schurtenberger

(10) Patent No.: US 6,951,072 B2
(45) Date of Patent: Oct. 4, 2005

(54) BARREL MOUNTED FOLDOUT GUNREST HOOK

(76) Inventor: Franz Xaver Schurtenberger, 702 10 ST, Canmore, Alberta (CA), T1W2A6

( * ) Notice: Subject to any disclaimer, the term of this patent is extended or adjusted under 35 U.S.C. 154(b) by 107 days.

(21) Appl. No.: 10/199,604

(22) Filed: Jul. 19, 2002

(65) Prior Publication Data

US 2004/0068911 A1 Apr. 15, 2004

(51) Int. Cl.[7] ..... F41A 29/00
(52) U.S. Cl. ..... 42/94; 248/216
(58) Field of Search ..... 248/216, 925; 42/94; 403/344; 211/64

(56) References Cited

U.S. PATENT DOCUMENTS 613,241 A * 11/1898 Burton ..... 42/86
636,599 A * 11/1899 White ..... 403/344
667,000 A * 1/1901 Bridges ..... 403/344
675,626 A * 6/1901 Grim ..... 403/344
897,577 A * 9/1908 Bourne ..... 42/59
1,409,023 A * 3/1922 Price ..... 417/233
1,441,285 A * 1/1923 Johnston et al. ..... 42/94
2,211,062 A * 8/1940 King ..... 294/17
2,229,334 A * 1/1941 Matz ..... 294/17
3,007,581 A * 11/1961 Moore
3,507,398 A * 4/1970 Schaefer ..... 211/4
4,054,394 A * 10/1977 Neuman ..... 403/344
4,364,592 A * 12/1982 Jackson ..... 294/26
5,360,199 A * 11/1994 Speier ..... 254/129
5,680,725 A * 10/1997 Bell ..... 42/127
5,934,112 A * 8/1999 Rice et al. ..... 70/18
5,934,410 A * 8/1999 Mahr ..... 182/221
6,315,256 B1 * 11/2001 Tolar ..... 248/230.4

* cited by examiner

*Primary Examiner*—Michael J. Carone
*Assistant Examiner*—Denise J Buckley
(74) *Attorney, Agent, or Firm*—Donald W. Meeker

(57) ABSTRACT

A barrel bracket in the form of a split ring is secured adjustably to a gun barrel at any point on the barrel and at any desired angle of orientation. A hook pivotally attached to the ring has a sharp point for piercing external structures, such as trees, fences, or other wooden objects to secure the barrel to the structure and act as a gun rest. The hook closes with the point shielded so that the gun may be carried and used normally since the attached gun rest is light weight and has no large protruding structures. Alternately, a built in barrel bracket is positioned on one side or the other or one on each side for right handed and left handed shooters.

10 Claims, 6 Drawing Sheets

BARREL MOUNTED FOLDOUT GUNREST HOOK

BACKGROUND OF THE INVENTION

1. Field of the Invention

The present invention relates to gun rests and in particular to a gun rest which mounts on or is built into the barrel of a rifle or other gun and has a fold out pointed hook which pierces into a tree fence or other wooden surface for supporting the rifle or gun for fast action aiming and firing with support.

2. Description of the Prior Art

When firing a gun, particularly a rifle with a long barrel, for greater accuracy in aiming and firing, a gun rest steadies the rifle supporting about half the weight of the rifle so that it allows the shooter to make better shots.

Often the shooter is in a blind or a tree stand, sitting or standing in a particular orientation for aiming at a target or intended target. Conventional gun rests usually have to be set up with the rifle or gun resting on the gun rest. Often there is no horizontal surface upon which to rest a conventional gun rest.

Often a fast action shot must be made sometimes after chasing an animal through the woods. There is no time to set up a conventional gun rest for these fast action shots.

While there are many gun rest patents, some of which attach to trees and others of which have pointed components for sticking into the ground, none have a simple, inexpensive, effective, lightweight and attachable gun rest capable of using any type of structure, oriented at any angle, to attach to and thereby solve the gun rest problem portably and simply, a gun rest which is always at the ready for fast action shots.

U.S. Pat. No. 613,241, issued Nov. 1, 1898 to Burton, concerns a rifle with a pivotable bayonet that can be stuck into the ground or rested on the ground or other object for use as a gun rest.

U.S. Pat. No. 1,298,920, issued Apr. 1, 1919 to Farago, illustrates a combination pistol and knife in which the knife may be pivoted downward for use as a gun rest.

U.S. Pat. No. 5,058,305, issued Oct. 22, 1991 to Majesty, discloses a shooting rest having a blade with a sharp point, the blade being attached to a handle with an enlarged butt section and having a curved concave area. A non-marring neoprene lining is affixed to the curved concave area. The enlarged butt section is pivotable about a longitudinal axis of the shooting rest by exerting a force that is adjustable. The pivotable butt section is secured, in one modification that is described, by a washer with protrusions that mesh with recesses. The butt section and the blade are held together in tension by a threaded member. The blade of the shooting rest has a curved concave area with a non marring neoprene insert, also, so that the shooting rest can be used by affixing it to a vertical surface.

U.S. Pat. No. 5,769,372, issued Jun. 23, 1998 to Klosterman, indicates a hunting weapon holder including a base which is connectable with a suitable support, such as a trunk of a tree, by a strap. A support assembly has an inner end portion which is pivotally connected with the base and an outer end portion which is spaced from the trunk of the tree. A weapon hanger is connected with the outer end portion of the support assembly. The support assembly includes a plurality of sections which are disposed in a telescopic relationship with each other. An inner one of the sections is pivotally connected with the base for pivotal movement about an axis which extends parallel to the tree trunk. An outer end portion of an outer one of the sections is pivotal about a second axis which extends parallel to the axis about which the inner section is pivotal.

U.S. Pat. No. 3,022,898, issued Feb. 27, 1962 to Loeb, is for a gun holder/gun rest with two spaced apart hooks for supporting a rifle and a belt which can be secured around a tree or other upright object.

U.S. Pat. No. 4,913,391, issued Apr. 3, 1990 to Klipp, provides a gun rest and sports equipment holder for use on railings of a tree stand, fence, porch deck, or the like includes a portable bracket with attaching clamp, a cradle for a gun rest and an optional adapter for holding spotting telescopes and cameras is adjustable for various viewing heights and azimuth angles by the attending hunter or sportsman and serves to stabilize the aiming of long barrel firearms, spotting scopes, or cameras.

U.S. Pat. No. 5,626,322, issued May 6, 1997 to Braun, shows a support and positioning system having: a platform for supporting a portable instrument, at least one member that connects the platform to a mounting device, and a mounting device that connects the system to a stable structure. In a preferred embodiment, the platform for supporting a portable instrument is included in a panhead, and the mounting device has two ends. One of these ends, in a preferred embodiment, is threaded for easy insertion into a stable structure, such as a tree or pole. In another preferred embodiment, the mounting device includes a belt and buckle that can be wrapped around and secured to the stable structure.

U.S. Pat. No. 5,819,463, issued Oct. 13, 1998 to Amos, describes a firearm rest having an elongate shaft with a Y shaped cradle such that the branches of the cradle are notched on their periphery, and there is a vertical hole located at a base of one of the branches. The present invention includes a camouflage screen that has a face screen portion and a body screen portion. The face screen portion of the camouflage screen is rectangular in shape and made from two pieces of material, thereby forming a pocket with an opening at its top side. The face screen portion attaches to the branches of the Y shaped cradle of a firearm rest. The body screen portion of the camouflage screen is trapezoidal in shape and attaches to the bottom of the face screen portion. The bottom of the body screen portion can be attached to the ground with stakes to provide broader coverage to a hunter. The present invention also includes an umbrella, the shaft of which fits through the vertical hole located in the Y shaped cradle. The umbrella is further attached to the firearm rest by using a U shaped bolt. The present invention can also be made with a tube having a twisting device located at its top end and a base platform at its bottom end. The elongate shaft of a firearm rest slides through the tube, and the twisting device frictionally holds the elongate shaft in any stationary position.

U.S. Pat. No. 5,491,920, issued Feb. 20, 1996 to McCullers, puts forth an adjustable firearm brace for supporting the first end of a firearm. The brace includes a base that has an attaching means for attaching the base to a generally vertical support, an arm having a first end that is pivotally connected to the base for generally horizontal rotation of the second end of the arm about the base, and structure for supporting the muzzle end of a firearm being attached to the second end of the arm.

What is needed is a simple, inexpensive, effective, lightweight and attachable gun rest to attach to any external support.

SUMMARY OF THE INVENTION

An object of the present invention is to provide a gun rest that is lightweight and attachable to or built into the barrel of the rifle or other type of gun to be carried permanently on the barrel without adding significant weight so that the gun rest as always available for use to enable steady fast action shots.

Another object of the present invention is to provide an adjustable gun rest that is attachable to any point along the length of the barrel and in any desired angular orientation to enable the shooter to attach the pivotable hook of the gun rest to any external structure in any location or spacial position.

One more object of the present invention is to provide a pivotable hook on the gun rest, which hook may be locked in an open position for piercing an external structure, preferably wood, to act as a gun rest and pivoted closed so that only a smooth ring surface of the gun rest encircles the barrel allowing the firearm to be used in a normal manner with the hook concealed.

A further object of the present invention is to provide a barrel mounted gun rest which may be positioned on either side of the barrel so that both right-handed and left-handed shooters can use the firearm effectively by hiding behind a tree with the firearm contacting the tree trunk and the hook piercing the wood of the tree trunk to steady the firearm for the shot.

In brief, a split ring with a screw tightener is adjustably attachable to a rifle or gun barrel at any desired point on the barrel. A pointed hook opens outwardly from the ring and pierces a tree, fence post or other rigid wooden structure for supporting the rifle or gun held adjacent to the structure and serve as a gun rest while aiming and shooting.

The portable gun rest is highly adaptable to fit anywhere on the barrel with a choice of any orientation of the hook through an entire 360 degrees depending on the location of the structure relative to the shooter and the direction of the intended target.

An advantage of the present invention is that it can remain on the barrel of the firearm at all times to be readily available whenever needed without adding significant weight or appendages to the firearm.

Another advantage of the present invention is that it can be positioned at any point on the barrel and in any angular orientation enabling use on any external structure able to be pierced by the pointed hook.

An additional advantage of the present invention is that the sharp point of the hook is capable of easily piercing wooden structures such as fences and trees and capable of pivoting closed to enable normal use of the firearm.

A further advantage of the present invention is that the portable gun rest may be positioned on either side of the barrel to facilitate use by both left-handed and right-handed shooters.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
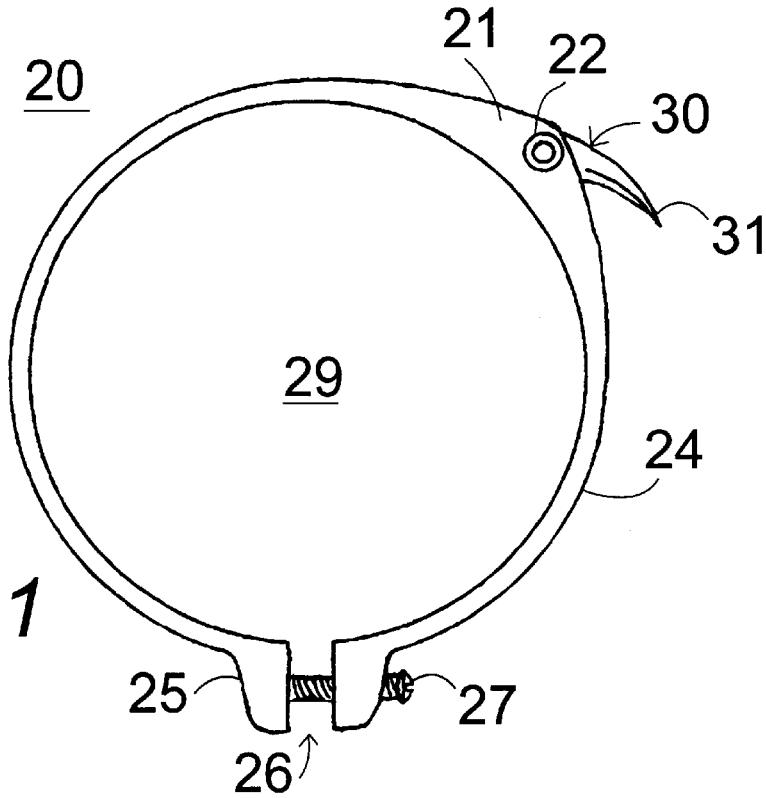
FIG. 1 is a front elevational view of the invention with the hook in the locked open position.
Figure 2:
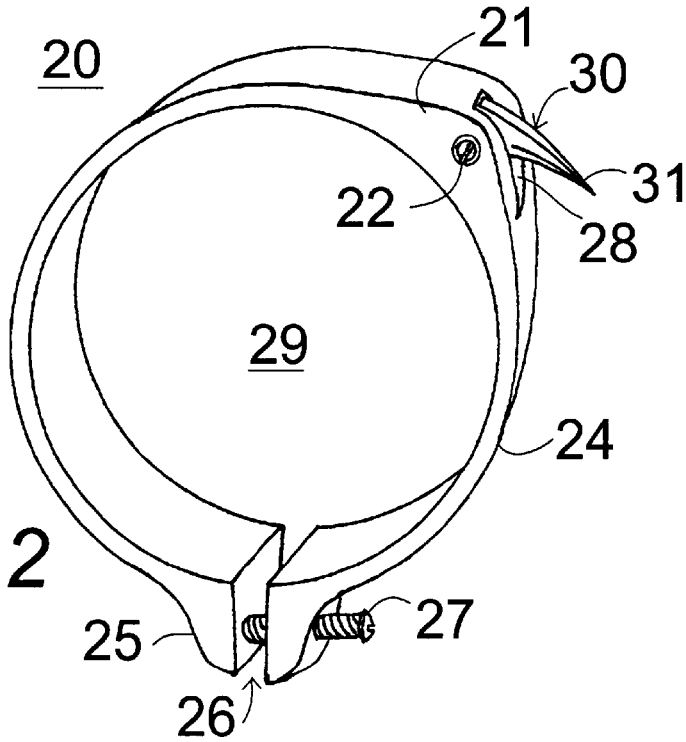
FIG. 2 is a perspective view of the invention with the hook in the locked open position.
Figure 3:
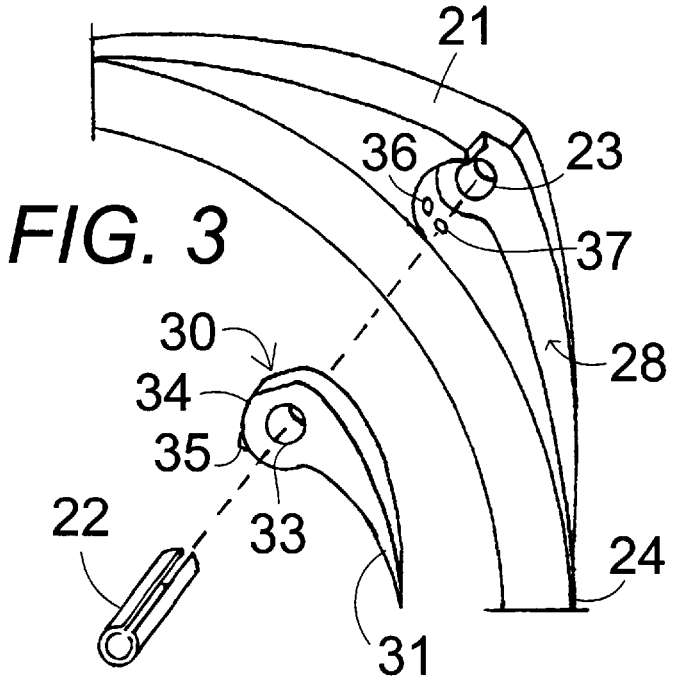
FIG. 3 is a partial broken view of the hook mechanism of the invention shown aligned for assembly.
Figure 4:
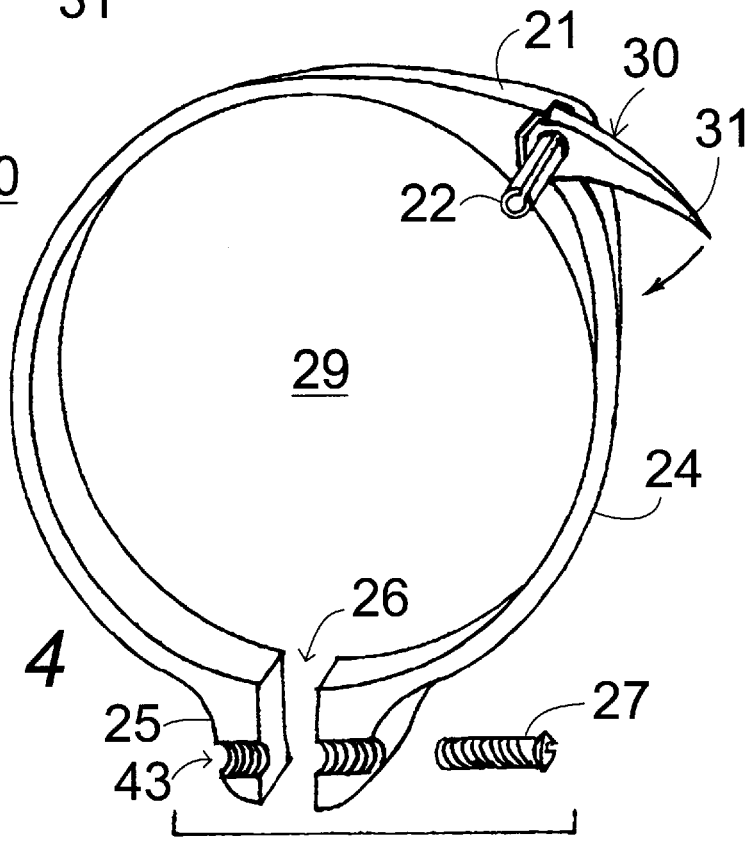
FIG. 4 is a partial broken view of the invention showing the hook mechanism and the screw and split ring assembly.

In FIGS. 1, 2, 4, and 6, an attachable gun rest device for attaching to a barrel 51 of a firearm, such as a rifle 50, in any position and in any angular orientation on the barrel, comprises a barrel bracket 20 in the form of a split ring adjustably attachable to the barrel and a hook 31 pivotally attached to the ring for piercing any external structure, such as a tree 60, temporarily attaching the barrel to the structure to serve as a gun rest for supporting the barrel end of the firearm to steady the aim of the shooter and assist in the support of the weight of the firearm.

The barrel bracket 20 is capable of being attached to a barrel of a firearm at any desired point along the length of the barrel, the barrel bracket having an adjustable attaching means, such as split ring protrusions 25 with a threaded hole 43 therethrough to receive a screw 27 connecting the split ring protrusions 25 across the split 26 therebetween for tightening the barrel bracket or ring 20 to the barrel or loosening the bracket or ring for sliding along the barrel or removal from the barrel.

Figure 5:
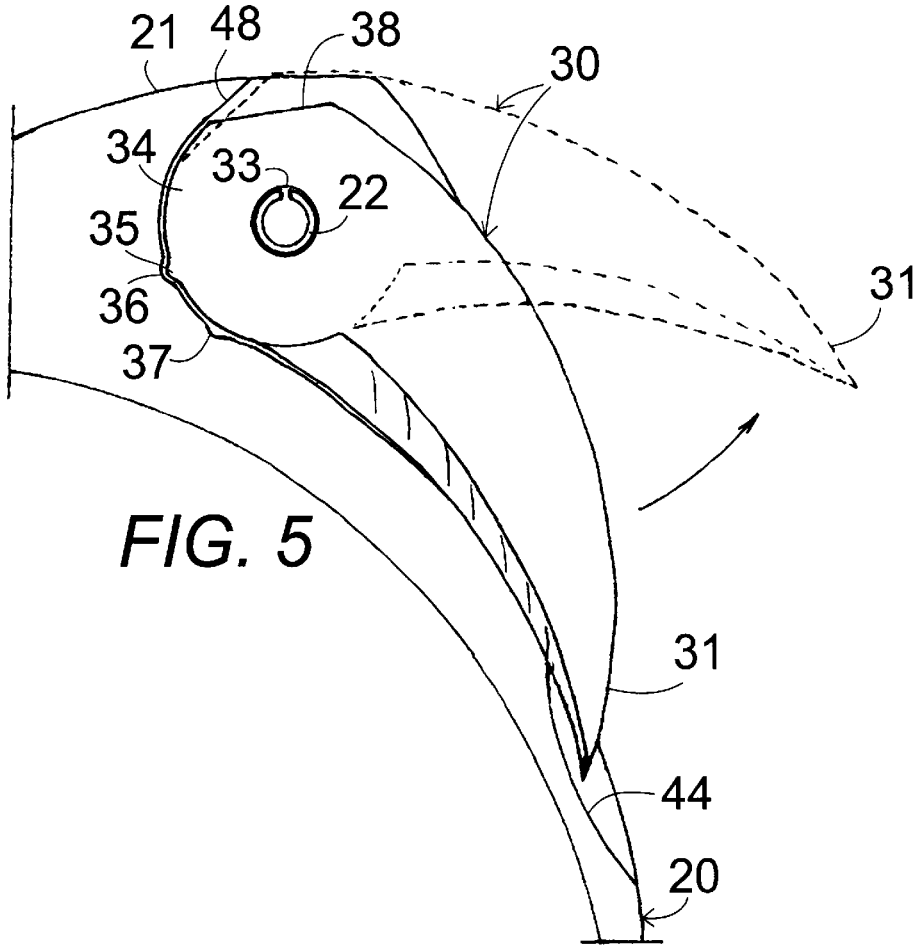
FIG. 5 is a broken enlarged view of the hook mechanism in a locked open position (shown dashed) and a closed position.
Figure 6:
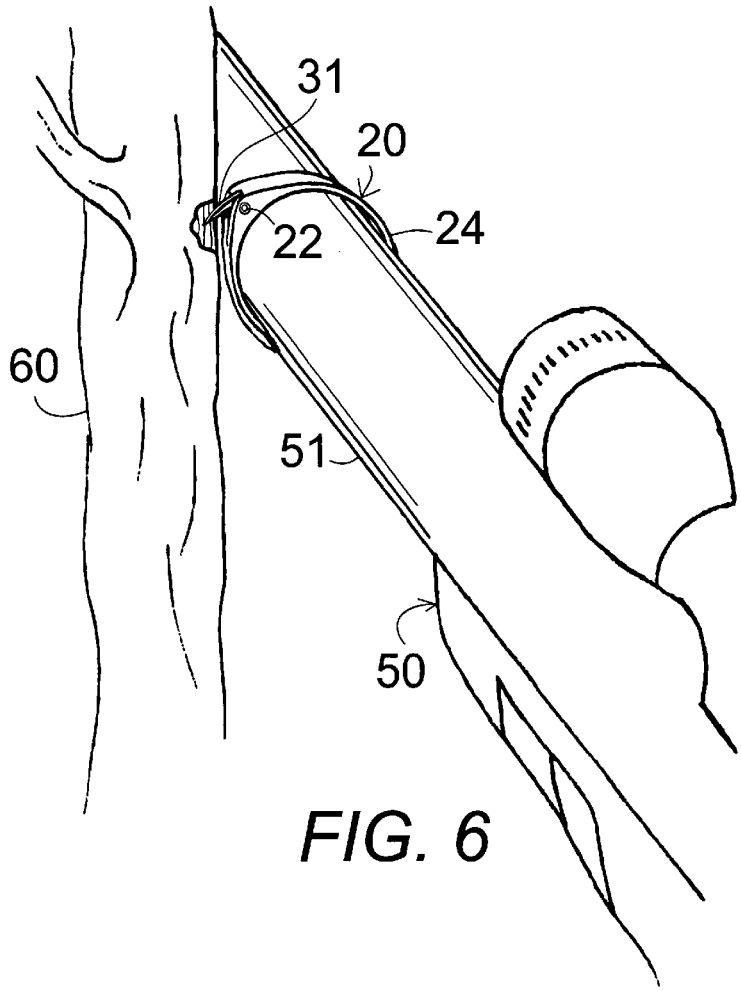
FIG. 6 is a perspective view of the invention mounted on a rifle barrel with the hook piercing the side of a tree trunk to serve as a gun rest.

A hook 39 having a sharp point 31 is pivotally attached to the barrel bracket 20 by a split shaft 22 through a hook opening 33 in a connector portion 34 of the hook and a hook receiving opening 33 in a hook receiving portion 21 which protrudes from the periphery of the ring 24, the hook being capable of opening to pierce an external structure, such as a tree 60, is in FIG. 6, to support the barrel 51 and the hook is further capable of closing into the barrel bracket in a hook receiving slot 28 with a recesses groove 44 to shield the point 31 of the hook 30, as seen in FIG. 5.

In FIG. 5, the hook 30 and barrel bracket ring 20 are provided with a protrusion on one of them and a pair of mating recesses on the other, such as the protrusion 35 on the hook 30 and the mating pair of recesses 36 and 37 on the ring 20 so that the protrusion 35 is capable of engaging one of the recesses 36 to lock the hook 30 in a closed position (shown with solid lines) and further capable of engaging the other of the recesses 37 to lock the hook 30 in an open position (shown dashed) for engaging an external structure. Mating flat surfaces 38 and 48 on the hook 30 and the barrel bracket 20, respectively mutually engage to resist relative rotation therebetween with the hook in the open position (shown dashed).

The barrel bracket 20 is capable of being oriented at any desired angle on the barrel 51 to orient the hook in a position for engaging the external structure, such as the vertical tree trunk 60 of FIG. 6. But it may be oriented to attach to structures above, below, or on either side of the barrel at any angle.

Figure 7:
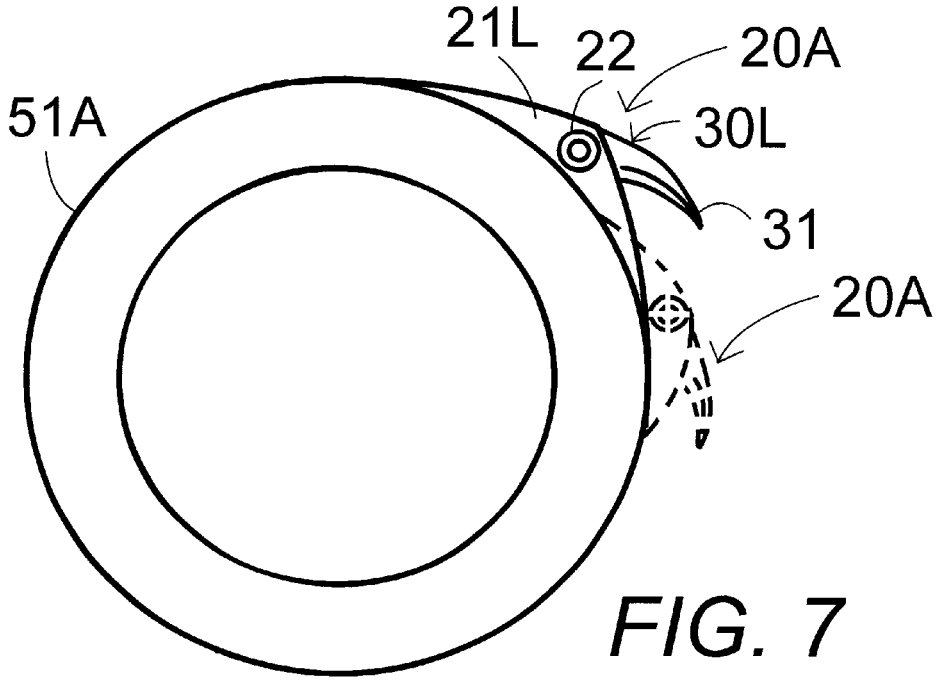
FIG. 7 is an end view of an alternate embodiment of the firearm barrel with the invention built into the barrel and the hook on the shooter's left side of the barrel for right handed shooters to position the firearm on the shooter's right side of a tree trunk.
Figure 8:
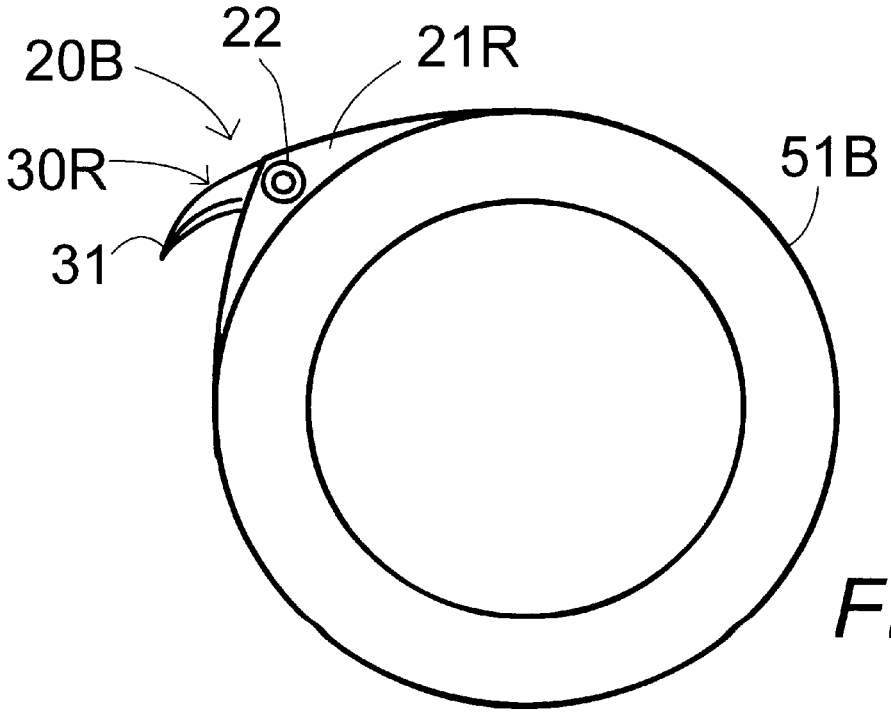
FIG. 8 is an end view of an alternate embodiment of the firearm barrel with the invention built into the barrel and the hook on the shooter's right side of the barrel for left handed shooters to position the firearm on the shooter's left side of a tree trunk
Figure 9:
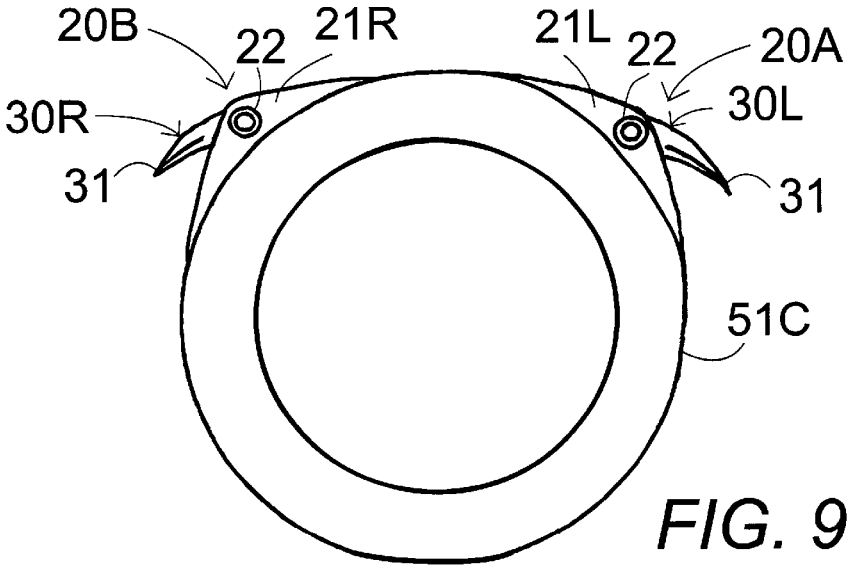
FIG. 9 is an end view of an alternate embodiment of the firearm barrel with the invention built into the barrel and a hook on each side of the barrel for right handed and left handed shooters.

In FIGS. 7 and 8 looking into the end of the gun barrel 51A and 51B, a built in version of the barrel bracket 20A and 20B has the hook receiving portion 21L and 21R built into the barrel 51A and 51B of the firearm. In FIG. 7 the hook receiving portion 21L is built into the left side of the barrel 51A from the shooter's perspective so that a right-handed shooter can hide behind a tree trunk, pivot out the hook 30L on the split ring 22 and pierce a right side of the tree trunk with the point 31 of the hook for an instant fast action gun rest. In FIG. 8 the hook receiving portion 21R is built into the right side of the barrel 51B from the shooter's perspective so that a left-handed shooter can hide behind a tree trunk, pivot out the hook 30R on the split ring 22 and pierce a left side of the tree trunk with the point 31 of the hook for an instant fast action gun rest. As in FIG. 9, the barrel bracket 21L and 21R may be built into the both sides of the firearm barrel 51C for both right and left handed shooters.

The split ring barrel bracket 20 of FIGS. 1, 2, 4, and 6 can be positioned on either side of the gun barrel 51 for left or right handed shooters in a similar orientation to the built in barrel brackets 20A and 20B of FIGS. 7 and 8 with the hook 30 opening up similar to the hook 30R and 30L opening up and the point 31 pointing downwardly to pierce the tree trunk on the right or left sides.

The barrel bracket and the hook are preferably fabricated of hardened steel to resist the shock of a recoil upon firing the firearm 50.

It is understood that the preceding description is given merely by way of illustration and not in limitation of the invention and that various modifications may be made thereto without departing from the spirit of the invention as claimed.

What is claimed is:

1. A barrel mounted gun rest device for attaching to a barrel of a firearm in any position and in any orientation to attach to any external structure to serve as a gun rest, the device comprising:

a barrel bracket adapted for being attached to a barrel of a firearm at any desired point along the length of the barrel;

a hook having a sharp point pivotally attached to the barrel bracket, the hook being adapted for opening to pierce an external structure to support the barrel and adapted for closing into the barrel bracket to shield the point of the hook;

wherein the barrel bracket is adapted for being oriented at any desired angle on the barrel to orient the hook in a position for engaging the external structure; and wherein the hook and barrel bracket are provided with a protrusion on one of them and a pair of mating recesses on the other so that the protrusion is adapted for engaging one of the recesses to lock the hook in a closed position and further adapted for engaging the other of the recesses to lock the hook in an open position.

2. The device of claim 1 wherein the barrel bracket comprises an adjustable attaching means for tightening the bracket to the barrel or loosening the bracket for sliding along the barrel or removal from the barrel.

3. The device of claim 2 wherein the barrel bracket comprises a split ring having a screw connecting the split ring as the adjustable attaching means.

4. The device of claim 1 wherein the barrel bracket is built into the barrel of the firearm at any desired point and any desired angle.

5. The device of claim 4 wherein the barrel bracket is built into the left side of the firearm barrel for a right handed shooter.

6. The device of claim 4 wherein the barrel bracket is built into the right side of the firearm barrel for a left handed shooter.

7. A barrel mounted gun rest device for attaching to a barrel of a firearm in any position and in any orientation to attach to any external structure to serve as a gun rest, the device comprising:

a barrel bracket adapted for being attached to a barrel of a firearm at any desired point along the length of the barrel:

a hook having a sharp point pivotally attached to the barrel bracket, the hook being adapted for opening to pierce an external structure to support the barrel and adapted for closing into the barrel bracket to shield the point of the hook;

wherein the barrel bracket is adapted for being oriented at any desired angle on the barrel to orient the hook in a position for engaging the external structure; and wherein the barrel bracket is built into the barrel of the firearm at any desired point and any desired angle; and wherein a barrel bracket is built into each of the sides of the firearm barrel for both right and left handed shooters.

8. The device of claim 7 wherein the hook and barrel bracket are provided with a protrusion on one of them and a pair of mating recesses on the other so that the protrusion is adapted for engaging one of the recesses to lock the hook in a closed position and further adapted for engaging the other of the recesses to lock the hook in an open position.

9. The device of claim 8 further comprising mating flat surfaces on the hook and the barrel bracket that mutually engage to resist relative rotation therebetween with the hook in the open position.

10. The device of claim 1 wherein the barrel bracket and the hook are fabricated of hardened steel to resist the shock of a recoil upon firing the firearm.

* * * * *